US008459148B2

(12) United States Patent
Kang et al.

(10) Patent No.: US 8,459,148 B2
(45) Date of Patent: Jun. 11, 2013

(54) BALL BALANCER AND LAUNDRY APPARATUS HAVING THE SAME

(75) Inventors: Dong Woo Kang, Changwon-si (KR); Youn Su Jung, Changwon-si (KR)

(73) Assignee: LG Electronics Inc. (KR)

( * ) Notice: Subject to any disclaimer, the term of this patent is extended or adjusted under 35 U.S.C. 154(b) by 820 days.

(21) Appl. No.: 12/461,264

(22) Filed: Aug. 5, 2009

(65) Prior Publication Data

US 2010/0116004 A1 May 13, 2010

(30) Foreign Application Priority Data

Aug. 6, 2008 (KR) ..... 10-2008-0076920

(51) Int. Cl.
*F16F 15/22* (2006.01)
*D06F 37/22* (2006.01)

(52) U.S. Cl.
USPC ..... 74/572.4; 68/23.2

(58) Field of Classification Search
USPC ..... 68/23.2; 74/572.4, 570.2
See application file for complete search history.

(56) References Cited

U.S. PATENT DOCUMENTS 4,044,626 A * 8/1977 Hayashi et al. ..... 68/23.1
4,433,592 A * 2/1984 Tatsumi et al. ..... 74/570.2
4,502,303 A * 3/1985 Wasemann ..... 68/23.2
4,646,545 A * 3/1987 Fanson et al. ..... 68/23.2
4,656,847 A * 4/1987 Bean et al. ..... 68/23.2
4,711,610 A * 12/1987 Riehl ..... 409/141
5,746,069 A 5/1998 Kim
5,806,349 A * 9/1998 Kim et al. ..... 68/23.2
5,870,908 A * 2/1999 Rushlow ..... 68/23.2
6,082,151 A * 7/2000 Wierzba et al. ..... 68/23.2
6,327,732 B1 * 12/2001 Braunschweig et al. ..... 8/159
6,389,628 B1 * 5/2002 Sears ..... 8/159
6,442,782 B1 * 9/2002 Vande Haar ..... 8/159
2004/0172987 A1 * 9/2004 Lim et al. ..... 68/23.1

FOREIGN PATENT DOCUMENTS

CN 1169484 A 1/1998
EP 0 810 317 12/1997
EP 0 811 717 12/1997
KR 0229631 B1 * 11/1999

OTHER PUBLICATIONS

Machine translation of KR 10-0229631 B1, Nov. 1999.*

* cited by examiner

*Primary Examiner* — Joseph L Perrin
(74) *Attorney, Agent, or Firm* — McKenna Long & Aldridge LLP

(57) ABSTRACT

A ball balancer and a laundry apparatus having the same are disclosed. A ball balancer includes a circular housing comprising motion space formed therein, a fluid inlet and an air outlet, a plurality of ball members movable in motion space of the housing, a closing member closing up the fluid inlet and the air outlet, and viscous fluid filled in the motion space via the fluid inlet formed in the housing. The ball balancer according to the present invention may be fabricated more efficiently.

8 Claims, 5 Drawing Sheets

BALL BALANCER AND LAUNDRY APPARATUS HAVING THE SAME

CROSS REFERENCE TO RELATED APPLICATION

This application claims the benefit of the Patent Korean Application No. 10-2008-0076920, filed on Aug. 6, 2008, which is hereby incorporated by reference as if fully set forth herein.

BACKGROUND OF THE DISCLOSURE

1. Field of the Disclosure

The present invention relates to a ball balancer and a laundry apparatus having the same. More particularly, the present invention relates to a ball balancer able to be manufactured efficiently and a laundry apparatus having the same.

2. Discussion of the Related Art

Generally, laundry apparatuses are home appliances that are used to remove dirt and foreign substances of clothes, cloth items and the like (hereinafter, laundry) which are put on by users. A laundry apparatus may be a washing machine and a dryer and a single appliance that performs washing and drying operation. Such the laundry apparatus includes an oriented rotatable drum within a cabinet defining an exterior appearance thereof. The drum is rotating and washing or drying operation is performed. The washing operation includes a washing, rinsing and drying-spinning cycle.

However, noise and vibration occur in a conventional laundry apparatus during the rotation of the drum. This would give unpleasant feeling to a user. Especially, in case a laundry apparatus is a washing machine or single appliance capable of performing washing and drying operation, substantially severe vibration and noise would be generated by a drum rotating at a high rotation number in the drying-spinning cycle.

The present invention is invented to solve the above problem and to provide a ball balancer able to reduce noise and vibration.

Another object of the present invention is to provide a ball balancer able to be manufactured efficiently.

SUMMARY OF THE DISCLOSURE

Accordingly, the present invention is directed to a ball balancer and a laundry apparatus having the same.

An object of the present invention is to provide a ball balancer able to reduce noise and vibration.

Another object of the present invention is to provide a ball balancer able to be manufactured efficiently.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a ball balancer includes a circular housing comprising motion space formed therein, a fluid inlet and an air outlet; a plurality of ball members movable in motion space of the housing; a closing member closing up the fluid inlet and the air outlet; and viscous fluid filled in the motion space via the fluid inlet formed in the housing.

Here, the fluid inlet and the air outlet may be formed in a centrifugal surface or both side surfaces of the circular housing.

The fluid inlet and the air outlet may be spaced apart a predetermined distance from a contact passage of the ball members in contact with an inner surface of the housing, respectively.

The closing member may be able to be inserted in the fluid inlet and the air outlet, formed in a shape corresponding to the fluid inlet and the air outlet, and the closing member may include a sealing member secured to the housing such that the closing member closes up the fluid inlet and the air outlet.

The ball balancer may further include at least two partition members spaced apart a predetermined distance from each other along the motion space of the housing, the at least two partition members partitioning the motion space into at least two spaces and the plurality of the ball members may be distributed in the partitioned spaces uniformly.

The fluid inlet and the air outlet may be provided in each of the partitioned spaces.

The viscous fluid may be able to pass the partition members and the ball members may be unable to pass the partition members.

The partition member may include a plurality of through holes, the size of the through hole substantially smaller than the size of the ball member.

In another aspect of the present invention, a laundry apparatus includes the ball balancer mentioned above.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
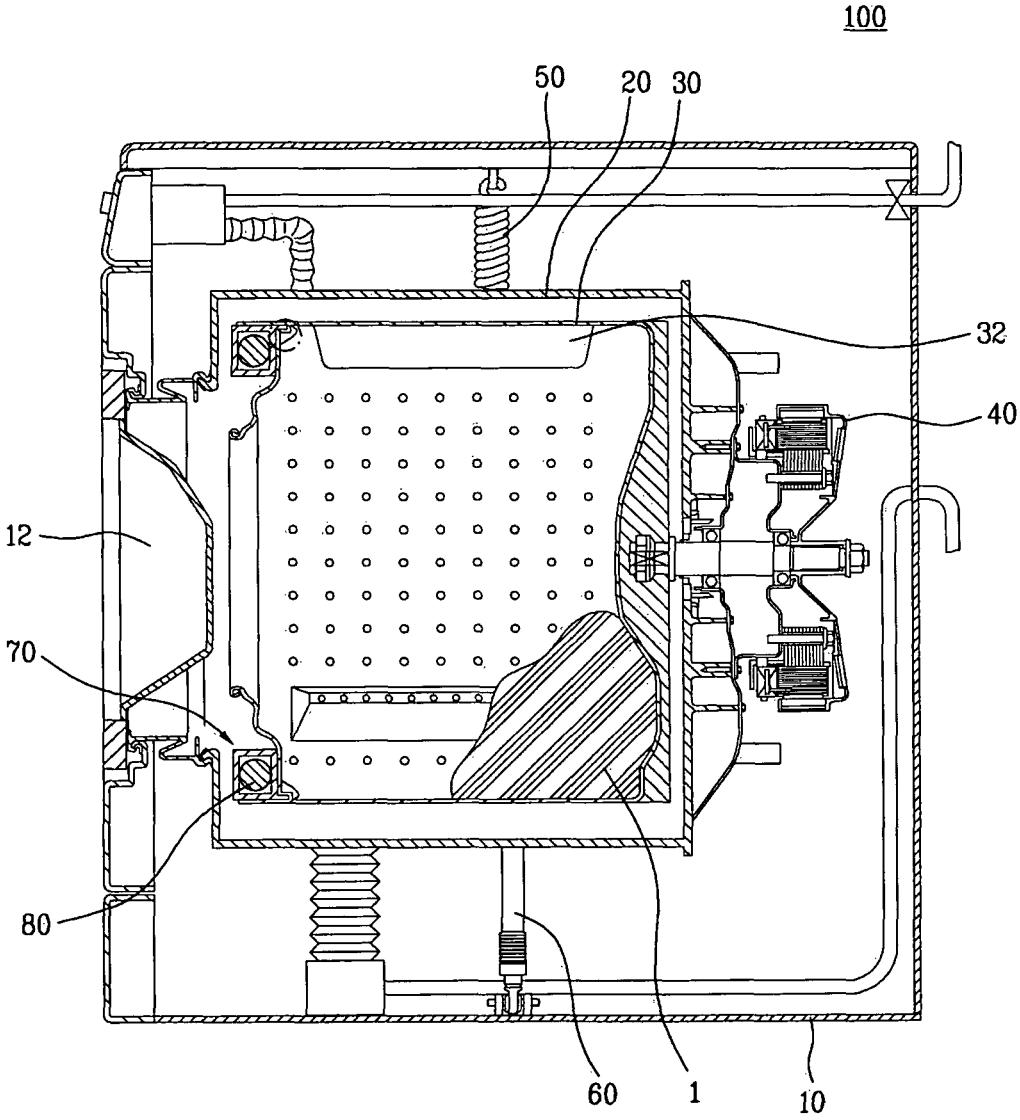
FIG. 1 is a side sectional view illustrating a laundry apparatus according to an exemplary embodiment of the present invention.

FIG. 1 is a side sectional view illustrating an inner configuration of a laundry apparatus according to an exemplary embodiment of the present invention.

In reference to FIG. 1, a laundry apparatus 100 according to this embodiment includes a cabinet 10, a tub 20 and a drum 30. The cabinet 10 defines an exterior appearance of the laundry apparatus. The tub 20 is provided in the cabinet 10 and it receives wash water therein. The drum 20 is rotatable within the tub 20.

In the cabinet 10 defining the exterior appearance of the laundry apparatus 100 according to this embodiment may be provided various components which will be described. A door 12 is coupled to a front of the cabinet 10 and a user will open the door 12 to introduce laundry into the cabinet 10.

The tub 20 receiving wash water is provided in the cabinet 10 and the drum 30 receiving laundry is rotatably provided in the tub 20. Here, a plurality of lifters 32 may be provided in the drum 30. During the rotation of the drum 30, the lifters 30 lift and drop the laundry to improve washing efficiency. Such the lifter 32 may be provided in plural. For example, according to this embodiment, the laundry apparatus 100 includes three lifters 32 provided in the drum 30 and the number of the lifters 32 may be variable, not limited thereto.

The tub 20 is elastically supported by a spring 50 and a damper 60. In case the drum 30 is rotated, vibration of the drum 30 is absorbed by the spring 50 and the damper 60 such that such the vibration may not be transmitted to the cabinet 10. In addition, a driving part 40 rotating the drum 30 is mounted to a rear of the tub 20 and the driving part 40 is configured of a motor to driving the drum 30 selectively. The configuration of such the driving part 40 is well-known in the art which the present invention pertains to and detailed description thereof will be omitted accordingly.

If laundry 1 is received in the drum 30 during the rotation of the drum 30 as shown in FIG. 1, much noise and vibration would be generated according to a position of laundry 1. That is, if the laundry 1 is not distributed inside the drum 30 uniformly, that is, if the drum 30 is eccentrically rotated with the laundry biased in one side, substantially much vibration and noise may be generated in the drum 30 because of the varying distribution of the laundry. To prevent the vibration and noise generated by the eccentric rotation of the drum 30, a ball balancer 70 may be provided in the drum 30.

The ball balancer 70 is provided in the rotating drum 30 and it is preferable that the ball balancer 70 is provided in a front of the drum 30. If the drum 30 is rotated at a high rotation number, for example, in a spinning cycle, the laundry would be collected in one side of the drum 30, that is, an inner rear portion of drum 30 and the ball balancer 70 balances the laundry collected in the rear portion of the drum 30.

Such the ball balancer 70 is mounted to the rotating drum 30 to prevent noise and vibration and it may move variously to compensate the eccentric rotation of the drum 30. That is, the ball balancer 70 includes predetermined material having a predetermined weight and a passage of which the material can move along a circumference. If load is concentrated on a predetermined side of the drum 30, the material provided in the ball balancer 70 moves to an opposite direction to the direction in which load is concentrated such that the noise and vibration generated by the eccentric rotation of the drum 30 may be prevented.

Here, the ball balancer 70 may be a liquid ball balancer having liquid with a predetermined weight or a ball balancer having a ball member with a predetermined weight. The laundry apparatus according to this embodiment presents a ball balancer having a ball member and viscous fluid which will be described as follows.

Figure 2:
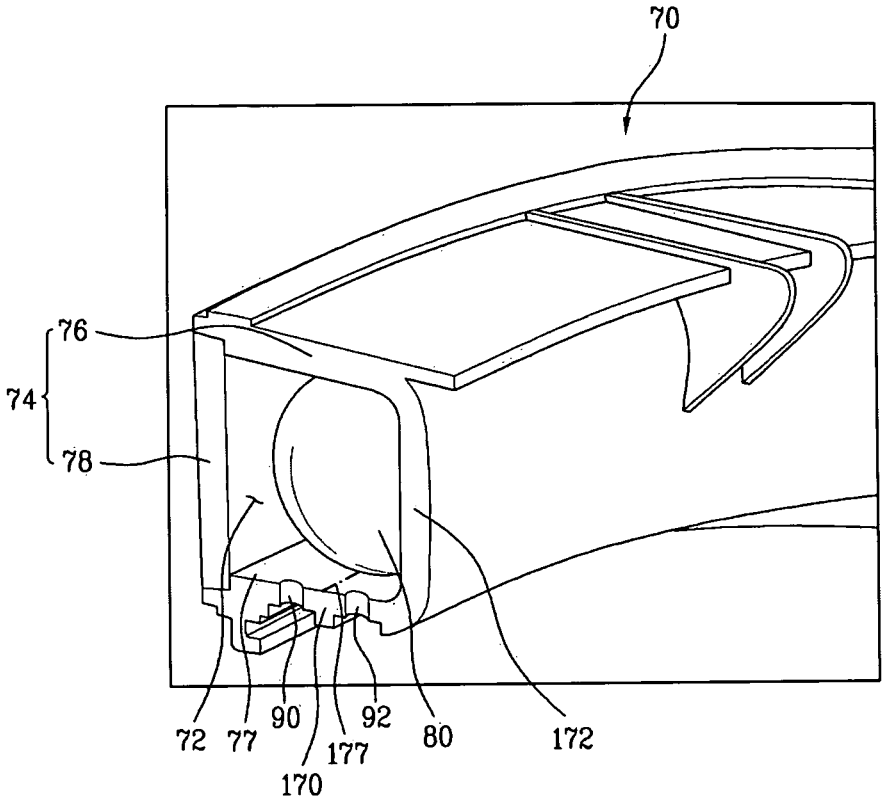
FIG. 2 is a sectional view illustrating an inner configuration of a ball balancer shown in FIG. 1.

FIG. 2 is a sectional view illustrating the ball balancer 70 provided in the drum shown in FIG. 1.

In reference to FIG. 2, the ball balancer 70 is secured to the drum 30 and it is rotated together with the drum 30 to compensate the eccentric rotation of the drum 30. That is, the ball balancer 70 according to a first embodiment of the present invention is secured to a front of the drum along an outer circumferential surface of the drum 30.

The drum 30 is rotated in a state of being fixed to the driving part 40. As the ball balancer is installed as far from the driving part as possible, a large moment is applied only by the small weight of the ball balancer 70 such that the eccentricity may be compensated. According to this embodiment, the ball balancer 70 is installed in the front surface of the drum to improve the efficiency of the ball balancer 70. Here, the present invention is not limited thereto and it is possible to install the ball balancer in a rear of the drum 30.

The ball balancer 70 may be installed to the drum 30 by a securing member (not shown). generally, it is possible to use a screw member passing the outer circumferential surface of the drum 30 from the front surface of the drum 30 which ends up to be secured to the ball balancer 70. Of course, the present invention is not limited to the above. Rather than the above presentation, the ball balancer 70 may be installed to the drum by another securing way such as a hook.

For example, a flange (not shown) extending forward along the outer circumferential surface of the drum may be formed in the front surface of the drum 30 and a seating groove (not shown) may be formed in the front surface of the drum 30. Then, the ball balancer 70 seated in the seating recess is secured to the drum by the securing member and it is rotated together with the drum 30 when the washing apparatus is put into operation.

As shown in FIG. 2, such the ball balancer 70 may be configured of a circular housing 74 having motion space 72. The housing 74 includes a body 76 having an open side and a cover 78 covering the open side of the body 76. that is, Viscous fluid is injected into the body 76 of the ball balancer 70, together with a ball member 80 which will be descried and the cover 78 is fabricated in the open side of the body 76 such that the ball balancer 70 may be manufactured.

Specifically, the ball balancer 70 includes a ball member 80 that is movable to compensate the eccentric rotation of the drum 30. A plurality of ball members 80 may be provided in the ball balancer 70 and they are movable along the motion space 72 of the ball balancer 70. As the housing 74 is formed circularly as mentioned above, the motion space 72 formed along the inside of the housing 74 may be formed along a passage of the circular shape as well. As a result, the ball member 80 provided in the ball balancer 70 may move along the circular motion space 72 and thus the eccentric rotation of the drum 30 is compensated. If then, the number of the ball members 80 injected into the ball balancer 70 may be 10 to 40, for example, and the number may be variable.

The ball members 80 provided in the ball balancer 70 may compensate the eccentric rotation of the drum 30. However, the ball members 80 would be collided against each other by the rotation of the drum 30 during their motion and this would cause noise. By extension, in case the drum 20 is rotated at the high rotation number, the ball members 80 would be collided against the housing 74 of the ball balancer 70 to result in damage to themselves. As a result, it is preferable that viscous fluid is provided in the ball balancer 70, together with the ball members 80. The viscous fluid may fill in the motion space 72 of the ball balancer 70 to prevent the rapid motion of the ball members 80 such that the noise and damage to the ball balancer 70 may be prevented. Such the viscous fluid may be configured of fluid having a predetermined weight, for example, silicon oil or the like.

The ball balancer 70 having the above configuration may be provided in the front of the drum 30. in case the drum 30 is rotated, especially, at the high rotation speed such as during the spinning cycle, the ball members 80 provided in the ball balancer 70 may move toward an opposite direction to the laundry received in the drum 30 and it may prevent the noise and the vibration caused by the eccentric rotation of the drum 30.

A process of manufacturing the ball balancer 70 having the above configuration will be described as follows. As mentioned above, the housing 74 of the ball balancer 70 includes the body 76 and the cover 78. After the body 76 and the cover 78 are fabricated separately, the viscous fluid and the ball members 80 may be provided inside the body 76 and the cover 78 may be assembled to the body 76.

However, the above assembling in that the body 76 and the cover 78 composing the housing 74 are fabricated separately may include steps of fabricating the body 76 and the cover 78 separately, injecting the ball members 80 and the viscous fluid, assembling the cover 78 to the body 76. This process including the steps will be complex and takes much time.

Thus, in recent have been developed a new process in that the body and the cover which compose the housing 74 may be injection-molded in a single device to be assembled immediately. Such a device injection-molds the body and the cover. Hence, the ball members 80 are introduced into the body and the cover is assembled with the body. However, even in this case, it is quite difficult to injection-mold the housing having the viscous fluid injected therein. As a result, in case the housing of the ball balancer is molded and fabricated by the injection method, a process of introducing the viscous fluid into the housing is necessary. In reference to corresponding drawings, a process of introducing the viscous fluid into the housing after the housing is fabricated will be described as follows.

In reference to FIG. 2 again, the housing 74 of the ball balancer 70 may include a fluid inlet 90 the viscous fluid passes and an air outlet 92 air passes.

When fabricating the ball balancer 70, the viscous fluid may be introduced into the housing 74 via the fluid inlet 90. During this process, the air outlet 92 is provided in the housing 74 for the viscous fluid to pass smoothly. That is, while introducing the viscous fluid into the housing via the fluid inlet 90, air inside the housing 74 is pressed by the viscous fluid and the air is discharged outside the housing 74 via the air outlet 92, such that the viscous fluid may be introduced into the housing 74 smoothly and efficiently.

After the viscous fluid is introduced into the housing 74, the viscous fluid happens to flow out via the fluid inlet 90 and the air outlet 92. To prevent the flowing of the viscous fluid, a closing member may close up the fluid inlet 90 and the air outlet 92 and the closing member will be described in detail later.

At this time, during the rotation of the drum 30, an external centrifugal force is applied along a semi-circumferential direction of the ball balancer 70 and then load is applied to the housing outwardly by the viscous fluid inside the housing 74.

Because of that, it is preferable that the fluid inlet 90 and the air outlet 92 are formed along an inner surface, that is, a centrifugal surface of the circular housing 74, not along an outer surface. If the fluid inlet 90 and the air outlet 92 are formed along the outer surface of the housing 74, load is applied to the inlet 90 and outlet 92 by the centrifugal force and this would result in deformity and damage to the closing member such that the viscous fluid may leak. To solve the problem, the fluid inlet 90 and the air outlet 92 of the ball balancer 70 according to this embodiment may be formed along the inner surface or both side surfaces of the housing 74.

Here, the inner surface of the housing 74 may be referenced to a centrifugal surface, that is, a surface 170 where the fluid inlet 90 and the air outlet 92 toward a center of the circular housing are formed in FIG. 2. The both side surfaces of the housing may be referenced to as surfaces 78 and 172 extending from the inner surface 170.

The fluid inlet 90 and the air outlet 92 are formed along the inner surface 170 or both side surfaces 78 and 172 of the housing. It is preferable that the fluid inlet 90 and the air outlet 92 are formed in the inner surface 170. The load of the centrifugal force is applied more toward an upper portion of the side surface of the housing 74. Because of that, the fluid inlet 90 and the air inlet 92 may be formed in predetermined portions of the side surfaces of the housing 74 that are adjacent to the inner surface of the housing 74.

If the fluid inlet 90 and the air outlet 92 are formed in the both side surfaces, either of the side surfaces 78 and 172 is corresponding to the cover 78 and thus it is preferable that the fluid inlet 90 and the air outlet 92 are formed in the other side surface 172, not the cover 78.

Also, the fluid inlet 90 and the air outlet 92 are spaced apart a predetermined distance from 'a moving contact passage' of the ball members in contact with the inner surface of the housing 74. The ball members 80 provided in the housing 74 move along the motion space 72 in a circumferential direction. Here, the ball member 80 has approximately spheral shape and the motion space 72 has approximately square shape such that the ball members 80 may move in contact with a center portion of a bottom surface of the motion space 72. That is, when the ball members 80 moving, the contact passage of the ball members 80 in contact with the center portion of the inner surface of the housing 74 may be formed.

As a result, the fluid inlet 90 and the air outlet 92 of the ball balancer 70 may be spaced apart a predetermined distance from the center portion of the inner surface of the housing 74. As shown in FIG. 2, the fluid inlet 90 and the air outlet 92 are spaced apart a predetermined distance from a center portion 177 of the inner surface 77 of the housing 74. as mentioned above, if the fluid inlet 90 and the air outlet 92 are formed along the contact passage of the ball members 80 in contact with the inner surface 77, the closing member closing up the fluid inlet 90 and the air outlet 92 would be deformed and damaged according to the motion of the ball members 80 such that the viscous fluid may leak.

Figure 3:
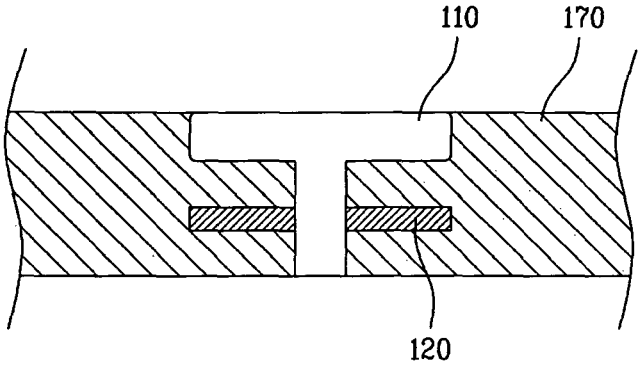
FIG. 3 is a sectional view partially illustrating a closing member shown in FIG. 2.

FIG. 3 is a sectional view illustrating the closing member of the ball balancer. Although FIG. 3 illustrates only the closing member closing the fluid inlet 90, the closing member closing up the air outlet 92 has a similar configuration to the closing member closing the fluid inlet 90.

In reference to FIG. 3, the closing member includes a closing member 110 and a sealing member 120. The closing member 110 closes up the fluid inlet 90 and the air outlet 92. The sealing member 120 prevents the viscous fluid from leaking via the fluid inlet 90 and the air outlet 92.

Specifically, adhesive material is coated on a surface of the closing member 110 having appearance corresponding to the appearance of the fluid inlet 90 and then the closing member 110 is fixedly inserted in the fluid inlet 90. Here, the sealing member 120 is provided in a predetermined portion of the fluid inlet 90 such that the viscous fluid may not leak along an aperture between the fluid inlet 90 and the closing member 110.

If the motion space 72 is a single space in communication in case of the ball members 80 being moved along the motion space 72 by the rotation of the drum 30, all of the ball members provided in the ball balancer 70 80 would be collected in one side. if all of the ball members 80 are collected in one side during the motion of the ball members 80 along the inside of the ball balancer 70 in case of a relatively large amount of laundry, the ball members and the laundry may be in balance. In case of a relatively small amount of laundry, the noise and vibration of the drum 30 may be accelerated by the ball members 80 collected in one side.

Because of that, according to this embodiment, the ball balancer 70 may include at least two partition members (71, see FIG. 4) formed along the inside of the housing 72 and partitioning the motion space 72 into at least two spaces.

Figure 4:
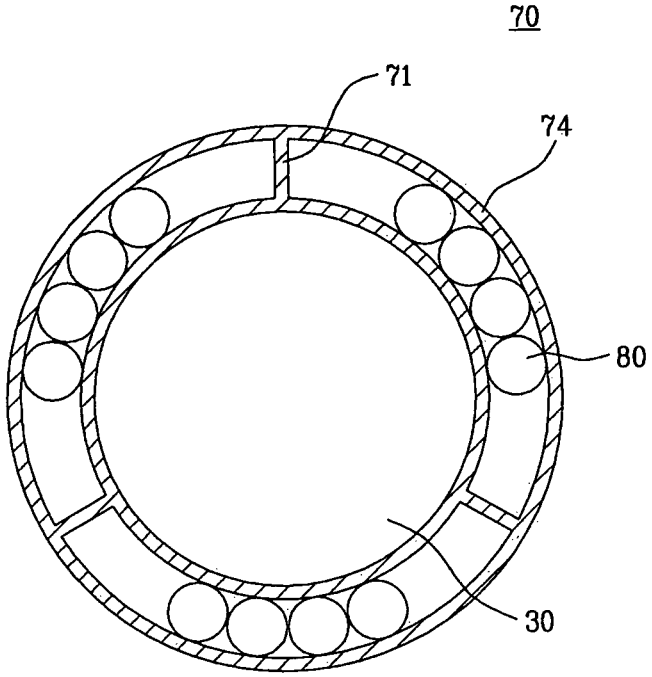
FIG. 4 is a front view illustrating a ball balancer shown in FIG. 1 according to a first embodiment of the present invention.

FIG. 4 illustrates a configuration of a ball balancer including the partition members according to a first embodiment.

In reference to FIG. 4, the partition members 71 are arranged along the motion space of the housing 74, such that the motion space 72 may be partitioned into at least two spaces. According to this embodiment, three partition members 72 are provided and they partition the motion space 72 into threes spaces. The number of the partition members is not limited to three and it may be variable appropriately.

If the partition members partition the motion space 72 into at least two spaces, the ball members 80 provided in the ball balancer 70 may be arranged in the partitioned motion space uniformly. The ball members 80 arranged in the partitioned spaces of the motion space 72 uniformly may be movable along the partitioned motion space 72 which they have arranged primarily and they may not pass the partition members 71. As a result, the ball members 80 may not be collected in one side within the motion space 72 during the rotation of the drum 30 and the noise and vibration caused by the eccentric rotation of the drum 30 may be prevented efficiently.

In case of including the partition members 71, the fluid inlets 90 and the air outlets 92 may be provided as many as the partitioned spaces of the motion space 72, respectively, to introduce the viscous fluid into each of the partitioned spaces.

Figure 5:
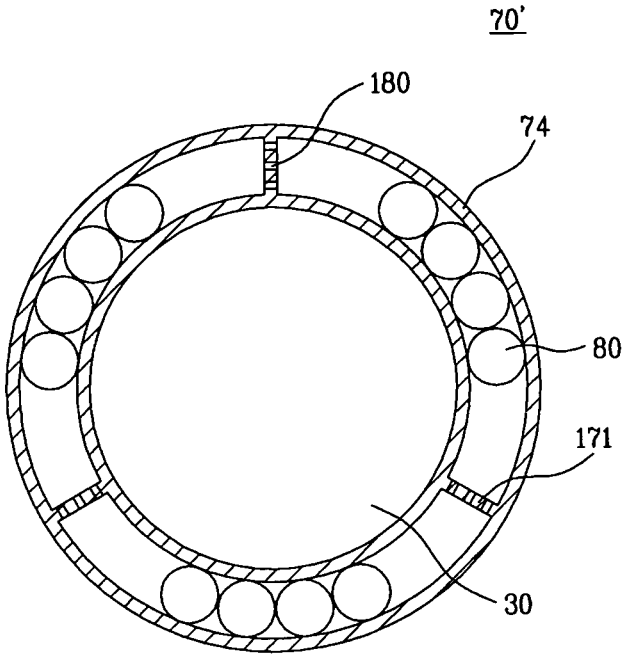
FIG. 5 is a front view illustrating a ball balancer shown in FIG. 1 according to a second embodiment of the present invention.

FIG. 5 illustrates a configuration of a ball balancer including partition members according to a second embodiment of the present invention. According to this embodiment of FIG. 5, the viscous fluid may pass partition members 171, which is different from the above embodiment.

During the rotation of the drum 30, the ball members 80 provided in the ball balancer 70' may be movable along the spaces of the motion space 72 partitioned by the partition members 171 and the viscous fluid filled in the ball balancer 70' may be movable regardless of the partition members 171, such that the noise and vibration caused by the eccentric rotation of the drum 30 may be prevented.

In reference to FIG. 5, according to the ball balancer 70' of this embodiment, the motion of the ball members is limited and the viscous fluid passess the partition members 171. Here, for example, a plurality of through holes 180 may be provided in each of the partition members 171. The partition members 171 having the plurality of the through holes, respectively, may limit the motion of the ball members 80 and allow the viscous fluid to pass along the partitioned spaces.

If the viscous fluid passes the partition members, the fluid inlet 90 and the air outlet 92 may not be provided in each of the partitioned space. It is possible to provide the fluid inlet 90 and the air outlet 92 with the one of the partitioned spaces. However, even in case the viscous fluid passes the partition members 171, it is preferable that the fluid inlet and the air outlet are provided in each of the partitioned spaces to supply the viscous fluid to the partitioned spaces of the motion space relatively fast.

As mentioned above, the ball balancer according to the embodiments of the present invention has the configuration in that the viscous fluid is introduced into the housing assembled primarily. As a result, the ball balancer may be fabricated more efficiently and firmly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A ball balancer comprising:

a circular housing comprising motion space formed therein, a fluid inlet and an air outlet;

a plurality of ball members movable in motion space of the housing;

a closing member closing up the fluid inlet and the air outlet;

viscous fluid filled in the motion space via the fluid inlet formed in the housing; and at least two partition members spaced apart a predetermined distance from each other in the circumferential direction of the housing, the at least two partition members partitioning the motion space into at least two spaces, wherein the viscous fluid is able to pass the partition members and the ball members are unable to pass the partition members.

2. The ball balancer of claim 1, wherein the fluid inlet and the air outlet are spaced apart a predetermined distance from a contact passage of the ball members in contact with an inner surface of the housing, respectively.

3. The ball balancer of claim 1, wherein the closing member is able to be inserted in the fluid inlet and the air outlet, formed in a shape corresponding to the fluid inlet and the air outlet, and the closing member comprises a sealing member secured to the housing such that the closing member closes up the fluid inlet and the air outlet.

4. The ball balancer of claim 1, wherein the plurality of the ball members are distributed in the partitioned spaces uniformly.

5. The ball balancer of claim 1, wherein the fluid inlet and the air outlet are provided in each of the partitioned spaces.

6. The ball balancer of claim 1, wherein the partition member comprises a plurality of through holes, the size of the through hole substantially smaller than the size of the ball member.

7. A laundry apparatus comprising the ball balancer of claim 1.

8. The ball balancer of claim 1, wherein the fluid inlet and the air outlet are formed in a centrifugal surface of the circular housing.

* * * * *